US012790806B2

(12) United States Patent
Killian et al.

(10) Patent No.: US 12,790,806 B2
(45) Date of Patent: Nov. 10, 2026

(54) CLOSET CARRIER ASSEMBLIES HAVING FRAMES

(71) Applicant: Watts Regulator Co., North Andover, MA (US)

(72) Inventors: Trent Killian, Bostic, NC (US); Gary Hodge, Rutherfordton, NC (US); Robert Diplacido, Erie, PA (US); Tyler Van Devon Herfel, Forest City, NC (US)

(73) Assignee: Watts Regulator Co., North Andover, MA (US)

( * ) Notice: Subject to any disclaimer, the term of this patent is extended or adjusted under 35 U.S.C. 154(b) by 99 days.

(21) Appl. No.: 18/409,157

(22) Filed: Jan. 10, 2024

(65) Prior Publication Data

US 2025/0223789 A1 Jul. 10, 2025

(51) Int. Cl.
*E03D 11/14* (2006.01)

(52) U.S. Cl.
CPC ..... *E03D 11/143* (2013.01)

(58) Field of Classification Search
CPC ..... E03D 11/14; E03D 11/143; E03D 11/146
See application file for complete search history.

(56) References Cited

U.S. PATENT DOCUMENTS

| | | | |
|---|---|---|---|
| 897,914 | A | 9/1908 | Madden |
| 1,051,086 | A | 1/1913 | Clark |
| 1,089,776 | A | 3/1914 | Mann |
| 1,211,471 | A | 1/1917 | Mann |
| 1,497,171 | A | 6/1924 | Haas |
| 1,676,276 | A | 7/1928 | Moore |
| 2,096,240 | A | 10/1937 | Groeniger |
| 2,138,135 | A | 11/1938 | Boucher |
| 2,145,645 | A | 1/1939 | Byers |
| 2,170,393 | A | 8/1939 | Tornblom |
| 2,373,280 | A | 4/1945 | Weber |
| 2,438,234 | A | 3/1948 | Stewart |
| 2,539,932 | A | 1/1951 | Schmitz, Jr. |
| 2,591,060 | A | 4/1952 | Garretson |
| 2,657,079 | A | 10/1953 | David |

(Continued)

FOREIGN PATENT DOCUMENTS

| | | | |
|---|---|---|---|
| JP | 53134226 | A | 11/1978 |
| JP | 1978134225 | A2 | 11/1978 |

OTHER PUBLICATIONS

Josam, 16123 Series Coated Cast Iron Single Commercial Closet Carrier and 3" PVC Plastic Fitting Adapter With Extension and chrome Plated Trim, "Closet Carrier, Floor Mount, PVC Adapter Type", Series 16123, 2018, 1 page.

*Primary Examiner* — Erin Deery
(74) *Attorney, Agent, or Firm* — Day Pitney LLP; George Chaclas; Christopher J. Head

(57) ABSTRACT

A closet carrier assembly for a wall-mounted toilet includes two spaced apart frames that are typically identical. Each frame includes a front leg and a rear leg with an arm connecting the front and rear legs to form an opening. At least one face plate has a passageway with an inlet for coupling to a wall mounted toilet. The face plate is preferably adjustably secured to the front legs of the frames. A waste pipe chase couples to an outlet of the passageway of the face plate. The waste pipe chase has at least one conduit extending through the opening between the legs of one of the frames.

12 Claims, 13 Drawing Sheets

(56) References Cited

U.S. PATENT DOCUMENTS 2,702,391 A 2/1955 Schmid
2,810,918 A 10/1957 Baker et al.
2,901,754 A 9/1959 Manas
2,932,037 A 4/1960 Manas
2,942,277 A 6/1960 Manas
2,945,240 A * 7/1960 Young ..... E03D 11/143 4/252.2
2,957,717 A 10/1960 Bram
3,014,223 A 12/1961 Pope
3,020,565 A 2/1962 Manas et al.
3,058,763 A 10/1962 Nott
3,078,477 A 2/1963 Schmid et al.
3,141,686 A 7/1964 Smith et al.
3,257,118 A 6/1966 Broadhead et al.
3,268,919 A 8/1966 Pope
3,271,794 A 9/1966 Flegel et al.
3,273,173 A 9/1966 Morris et al.
3,298,720 A 1/1967 Driancourt
3,319,267 A 5/1967 Pope
3,323,143 A 6/1967 Pope
3,398,979 A 8/1968 Pope
3,400,411 A 9/1968 Harvey
3,495,283 A * 2/1970 Studer ..... E03D 11/143 4/252.2
3,540,065 A 11/1970 Gidner et al.
3,547,471 A 12/1970 Dunmire
3,664,690 A 5/1972 Williams et al.
3,686,695 A 8/1972 Mielback et al.
3,732,582 A 5/1973 Mielbeck et al.
4,058,859 A 11/1977 Arrowood
4,092,036 A 5/1978 Sato et al.
4,108,477 A 8/1978 Morris
4,482,161 A 11/1984 Izzi, Sr.
4,502,166 A 3/1985 Brown, Sr.
4,538,307 A 9/1985 Barnum et al.
4,544,188 A 10/1985 Dugger
4,647,083 A 3/1987 Hashimoto
4,874,192 A 10/1989 Key
4,967,425 A 11/1990 Kawamura et al.
4,979,239 A 12/1990 Klein et al.
4,984,308 A 1/1991 Handal
5,398,980 A 3/1995 Hunter et al.
5,502,845 A 4/1996 Hayashi et al.
5,724,773 A * 3/1998 Hall ..... E04H 3/02 52/220.8
5,887,913 A 3/1999 Kojima et al.
6,000,070 A 12/1999 Bonin
6,301,838 B1 10/2001 Hall
6,496,989 B1 12/2002 Meiser
6,679,460 B2 1/2004 Nicolia et al.
6,928,669 B2 8/2005 Akin
6,979,027 B2 12/2005 Hetzler et al.
7,096,520 B2 * 8/2006 Nicolia ..... E03C 1/322 248/688
7,571,497 B2 8/2009 Hetzler et al.
8,141,177 B1 3/2012 Majocka et al.
8,291,525 B2 * 10/2012 Pondelick ..... E03D 11/02 4/316
8,321,967 B2 12/2012 Mesun et al.
8,505,124 B2 8/2013 Eichler et al.
8,528,121 B2 9/2013 Stonecipher et al.
8,544,121 B1 10/2013 Majocka et al.
8,657,343 B2 2/2014 Rodenberg et al.
8,887,319 B2 11/2014 Whiteside
9,464,426 B1 10/2016 Schaetzke et al.
10,060,114 B2 8/2018 Morris et al.
10,358,805 B2 7/2019 Tanimoto et al.
10,858,815 B2 12/2020 Fratantonio et al.
10,895,070 B2 1/2021 Hodge
2004/0133969 A1 7/2004 Akin
2014/0310860 A1 10/2014 Wroblewski et al.
2016/0090726 A1 3/2016 Verdecchia
2024/0035268 A1 2/2024 Adams et al.

* cited by examiner

CLOSET CARRIER ASSEMBLIES HAVING FRAMES

BACKGROUND OF THE INVENTION

1. Field of the Invention

The subject disclosure relates to closet carriers for wall-mounted toilets, and more particularly to closet carriers having frames designed for easier handling and installation.

2. Background of the Related Art

Many toilets, particularly in commercial buildings, are wall hung. As a result, the drain pipe passes through the wall rather than the floor. The closet carrier that supports the toilet must be robust to carry a large load while facilitating a secure fluid-tight connection to the waste pipe. For example, see: U.S. Pat. No. 10,858,815 issued on Dec. 8, 2020 to Watts Regulator Co.; U.S. Pat. No. 10,851,534 issued on Dec. 1, 2020 to Watts Regulator Co.; U.S. Pat. No. 10,895,070 issued on Jan. 19, 2021 to Watts Regulator Co.; and U.S. Pat. No. 6,979,027 issued on Dec. 27, 2005 to Watts Regulator Co.

SUMMARY OF THE INVENTION

Many prior art closet carriers are solid metal components designed to support well in excess of a normal weight during typical use. These closet carriers are heavy, which creates difficulty in transport and installation. Further, the heft and design may require multiple people to perform the installation. In view of the above, a need exists for a closet carrier assembly that is lighter to facilitate easy transport and quick, easy installation. The subject technology allows for easy manufacture, less raw material, and adjustments to fine tune the installation.

In one embodiment, the subject technology is directed to a closet carrier assembly for a wall-mounted toilet that includes two spaced apart frames that are typically identical. Each frame includes a front leg and a rear leg with an arm connecting the front and rear legs to form an opening. At least one face plate has a passageway with an inlet for coupling to a wall mounted toilet. The face plate is preferably adjustably secured to the front legs of the frames. A waste pipe chase couples to an outlet of the passageway of the face plate. The waste pipe chase has at least one conduit extending through the opening between the legs of one of the frames.

The face plate may be secured to front sides of the front legs of the frames. Spacing rods may extend from front sides of the front legs of the frames and through openings in the face plate, wherein distal ends of the spacing rods are adapted to receive a wall-mounted toilet. Preferably, a vertical position of the rods on the frames can be adjusted. In one embodiment, the conduit of the waste pipe chase comprises opposing first and second conduits, wherein the first conduit extends between the legs of the first frame and the second conduit extends between the legs of the second frame. There may also be a lower arm so that the conduit of the waste pipe chase extends between the legs and the arms of the frame. Preferably, the frames include one or more openings to reduce weight and/or provide a handle. In order to level the closet carrier assembly, the legs of the frames can extend upwardly from feet and the assembly can further include stackable shims for placement under the feet. If needed, the closet carrier assembly can include a first face plate secured to the front legs of the frames and a second faceplate secured to the rear legs of the frames with the waste pipe chase coupled to each of the outlets of the passageways of the face plates. Preferably, the frames are fabricated from plastic with structural webs extending between structural flanges. If necessary, the frames can include ribs connected to the webs and the flanges for additional structural reinforcement.

In another embodiment, the subject technology is directed to a frame assembly for a closet carrier assembly for a wall-mounted toilet assembly. The wall-mounted toilet assembly includes a face plate defining: an inlet configured to couple to the wall-mounted toilet; and an outlet in fluid communication with the inlet. A waste pipe chase conduit has: a first portion configured to couple to the outlet of the face plate; and a second portion in fluid with the first portion and extending at an angle from the first portion. The frame assembly includes first and second frames configured to be spaced apart. Each frame includes a proximal post configured to couple to the face plate, a distal post, and a top chord portion connecting the proximal and distal posts so that the top chord portion and the proximal and distal posts of the first frame form an arch around the second portion of the conduit.

Preferably, each proximal post forms two threaded anchor bores that provide structural support and the face plate forms four holes with four spacing rods, each rod configured to extend through one of the four holes with a distal end configured to secure in the threaded holes and a proximal end configured to couple to the toilet assembly. The frames may be fabricated from plastic, each proximal post can form two additional threaded anchor bores for selectively coupling the four spacing rods in a different location, and each threaded anchor bore includes a threaded metal insert. In one embodiment, the first frame includes a bottom chord portion connecting the proximal and distal posts so that the top chord portion, the bottom chord portion, the proximal post, and the distal post of the first frame are configured to encircle the second portion of the conduit. The first frame may include an intermediate chord handle portion coupled to the top chord portion to form a recess to facilitate manually carrying the first frame, and the first frame defines a vent passage parallel to the posts of the first frame. There may also be provided, in a kit or otherwise, one or more stackable shims for leveling the closet carrier assembly by putting the stackable shim(s) under a foot of the post.

In still another embodiment, the subject disclosure is directed to a closet carrier assembly for a wall-mounted toilet assembly that includes a face plate defining: an inlet configured to couple to the wall-mounted toilet; and an outlet in fluid communication with the inlet. A waste pipe chase conduit has: a first portion configured to couple to the outlet of the face plate; and a second portion in fluid with the first portion and extending at an angle from the first portion. A frame assembly includes first and second frames configured to be spaced apart. Each frame includes a proximal post configured to couple to the face plate and terminating in a first foot configured to be mounted to floor on a first side of the second portion of the waste pipe chase conduit. Each frame also includes a distal post terminating in a first foot configured to be mounted to floor on a second side of the second portion of the waste pipe chase conduit. A top portion connects the proximal and distal posts.

It should be appreciated that the subject technology can be implemented and utilized in numerous ways, including without limitation as a kit, a process, an apparatus, a system, a device, a method for applications now known and later developed. These and other unique features of the system disclosed herein will become more readily apparent from the following description and the accompanying drawings.

BRIEF DESCRIPTION OF THE DRAWINGS

So that those having ordinary skill in the art to which the disclosed technology appertains will more readily understand how to make and use the same, reference may be had to the following drawings.

DETAILED DESCRIPTION OF PREFERRED EMBODIMENTS

Figure 1:
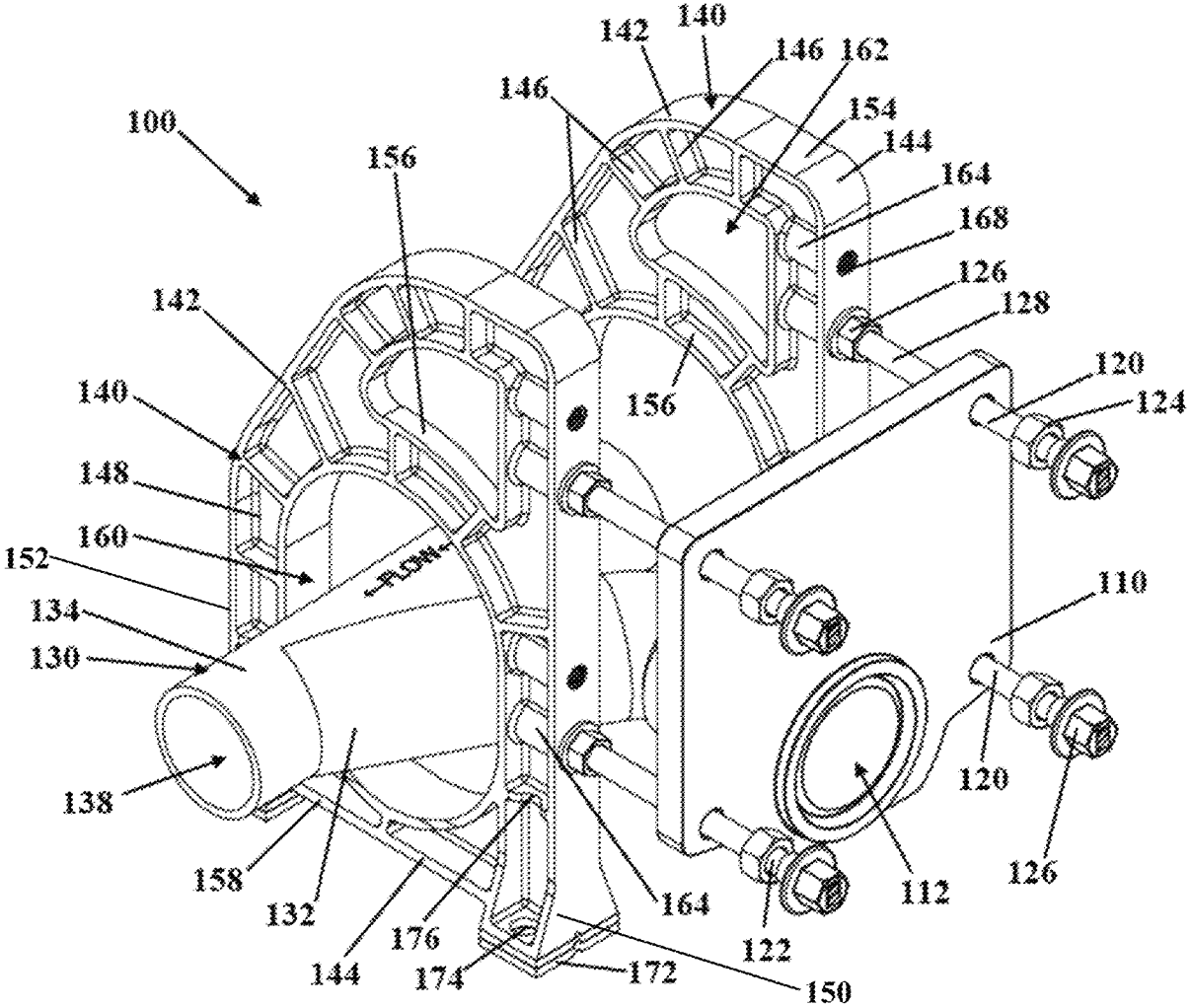
FIG. 1 is a front perspective view of a closet carrier assembly in accordance with the subject technology.

The subject technology overcomes many of the prior art problems associated with closet carriers for wall-mounted toilets. The advantages, and other features of the technology disclosed herein, will become more readily apparent to those having ordinary skill in the art from the following detailed description of certain preferred embodiments taken in conjunction with the drawings which set forth representative embodiments of the present technology and wherein like reference numerals identify similar structural elements. Directional indications such as front, back, upward, downward, right, left and the like are used with respect to the figures and not meant in a limiting manner.

Referring now to FIGS. 1-5, there are shown various views of a closet carrier assembly 100 for a wall-mounted toilet (not shown). In brief overview, the subject technology includes lightweight, easy to carry and install frames that are suitably strong to meet the support requirements of a wall-mounted toilet. The closet carrier assembly 100 includes a face plate 110 supported by four threaded rods 120. The threaded rods 120 are supported by and extend from a frame assembly 140. Proximal ends 122 of the threaded rods 120 have nuts 124 and nut assemblies 126 for securing the toilet thereto. The face plate 110 also couples to a waste pipe chase conduit 130 that extends through the frame assembly 140.

Figure 9:
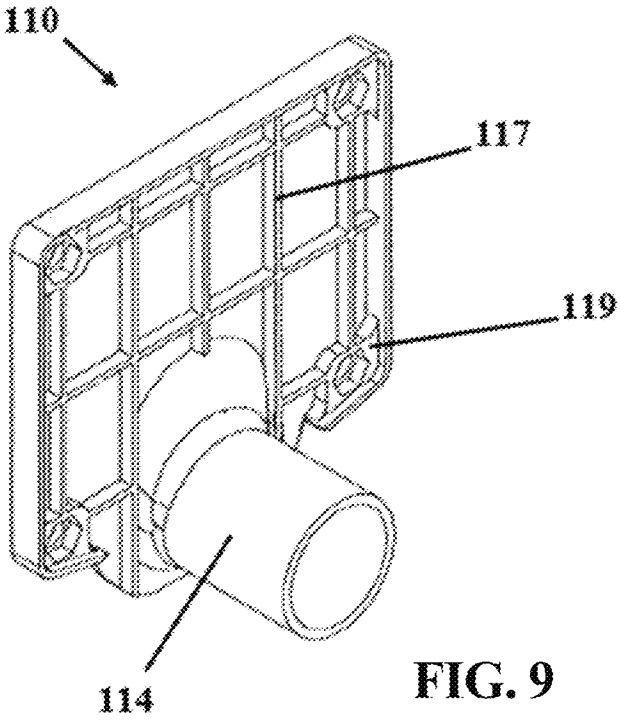
FIG. 9 is a back perspective view of the faceplate of FIG. 6.
Figure 8:
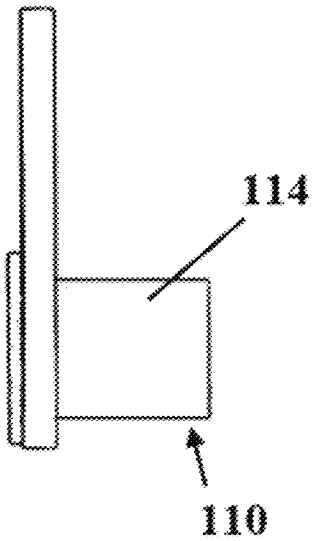
FIG. 8 is a side plan view of the faceplate of FIG. 6.

Now referring additionally to FIGS. 6-9 that show the face plate 110 in isolation, the face plate defines an inlet 112. The inlet 112 is configured to couple to a waste pipe of the wall-mounted toilet and a nipple or other intermediate connection may be utilized as needed. The face plate 110 also includes an outlet 114 in fluid communication with the inlet 112 and the waste pipe chase conduit 130. The inlet 112 and the outlet 114 may be of any configuration, such as threaded, as long as a secure, fluid-tight connection is created. The face plate 110 forms four throughholes 116 for receiving the rods 120. The face plate 110 may be metal or plastic as well as solid. As shown in FIG. 9, the face plate 110 includes support strengthening ribs 117. As a result, the face plate 110 may be made of plastic and include corner recesses 119 molded to house the nuts 126.

Figure 12:
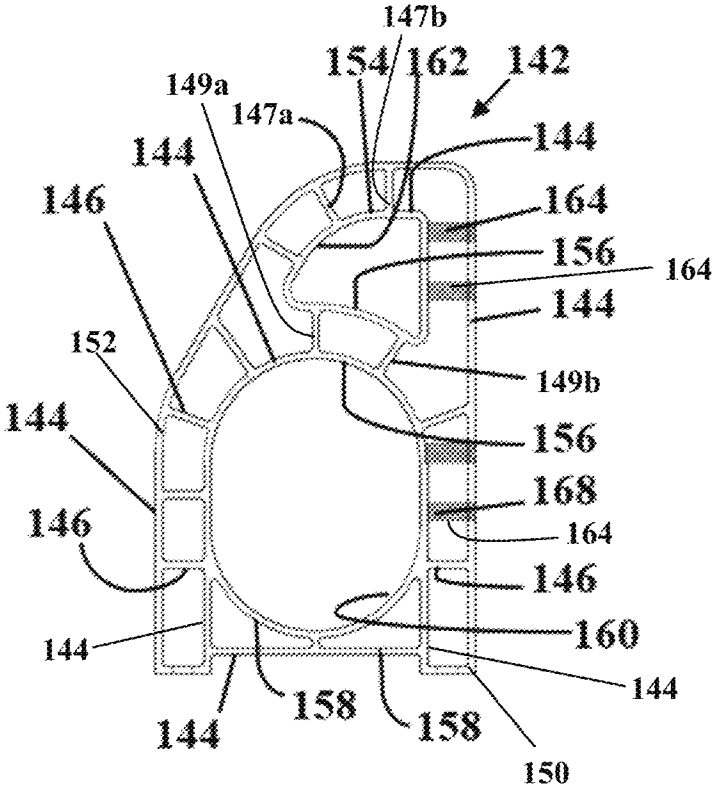
FIG. 12 is a side plan view of the frame of FIG. 10.
Figure 11:
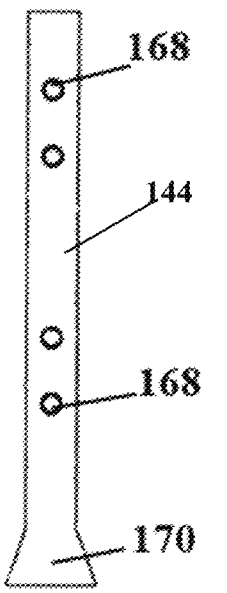
FIG. 11 is a front plan view of the frame of FIG. 10.
Figure 10:
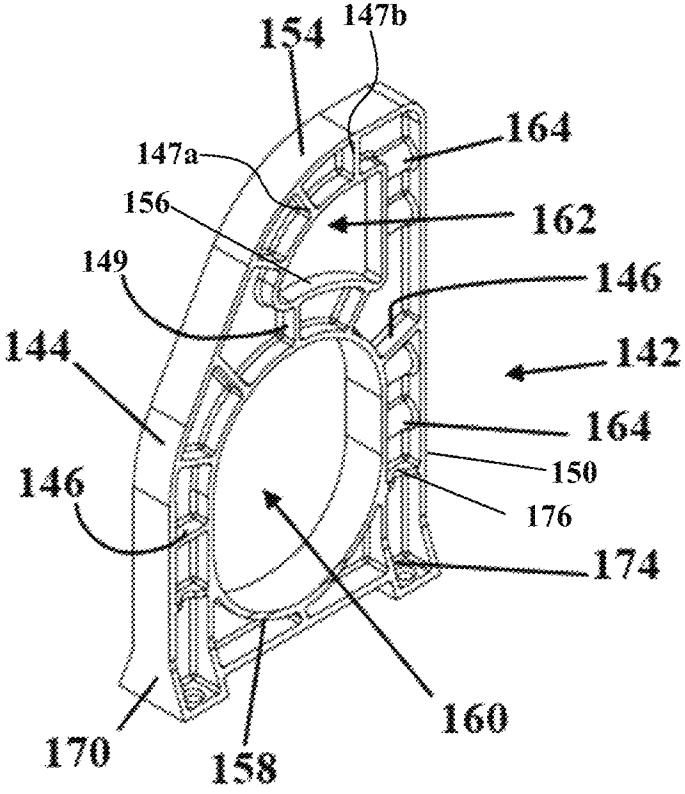
FIG. 10 is a perspective view of an isolated frame for the closet carrier assembly of FIG. 1.
Figure 13:
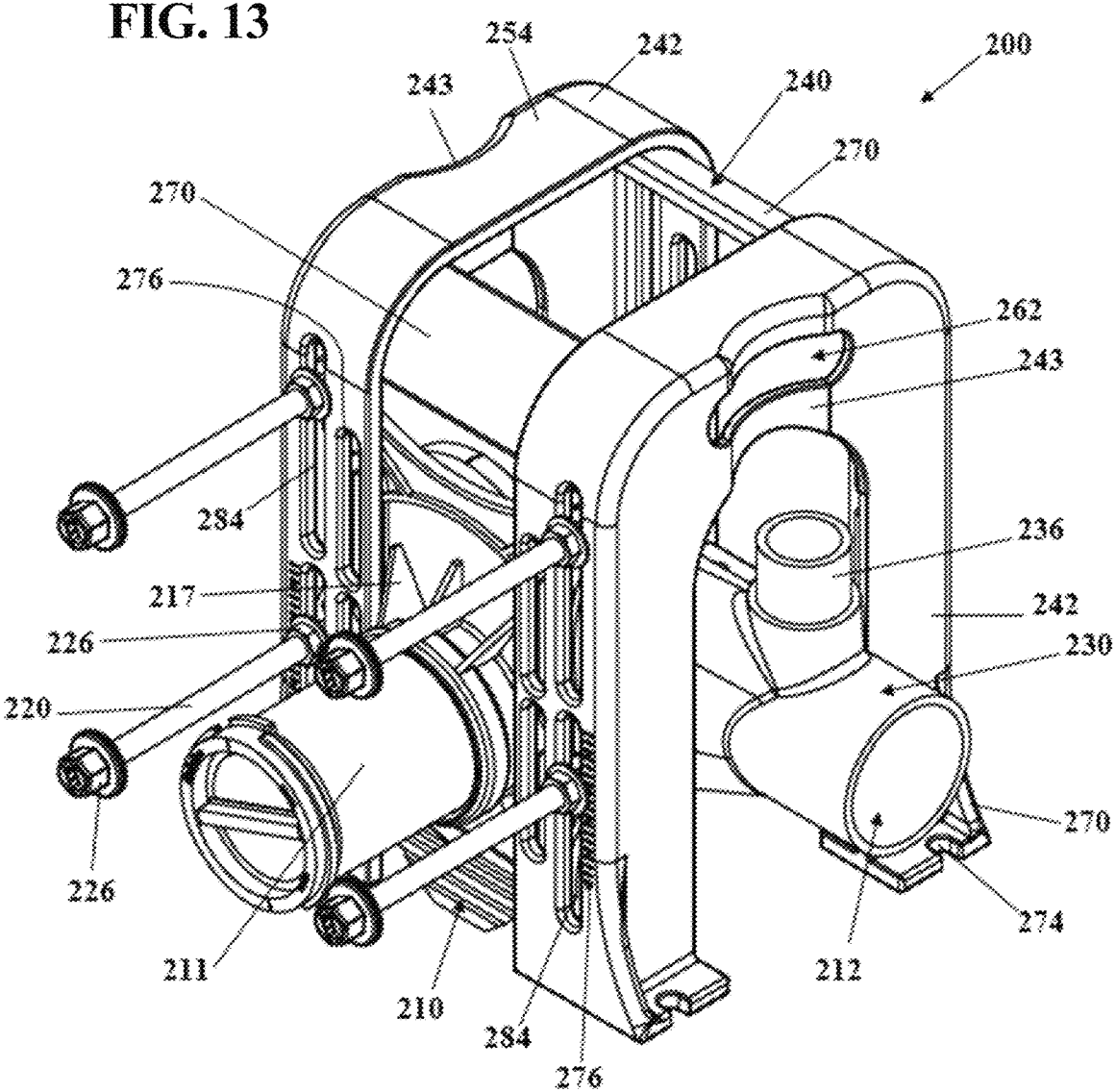
FIG. 13 is a front perspective view of another closet carrier assembly in accordance with the subject technology.
Figure 15:
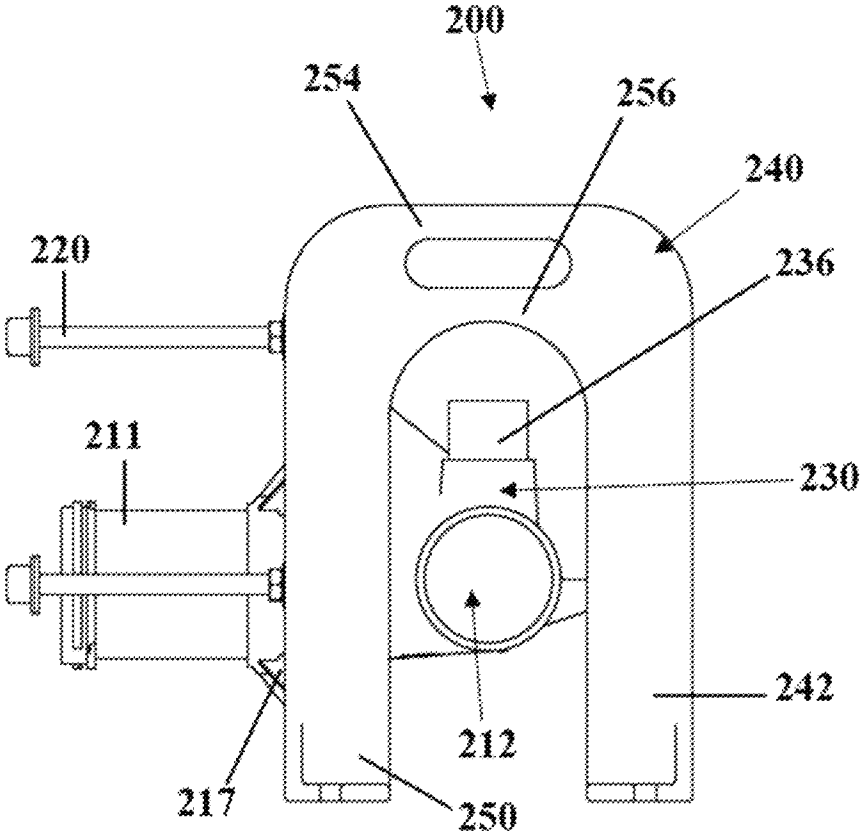
FIG. 15 is a side plan view of the closet carrier assembly of FIG. 13.
Figure 14:
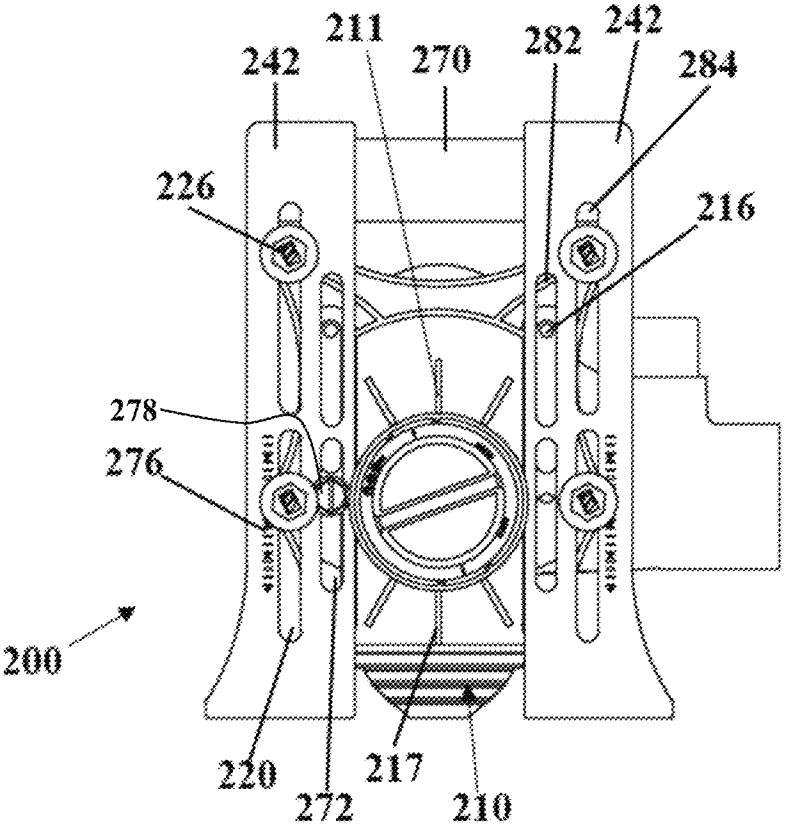
FIG. 14 is a front plan view of the closet carrier assembly of FIG. 13.

Still referring to FIGS. 1-5, the waste pipe chase conduit 130 has a first elbow portion 132 configured to couple to the outlet 114 of the face plate 110. A second straight portion 134 of the waste pipe chase conduit 130 is in fluid with the first portion 132. The second straight portion 134 extends substantially parallel to the face plate 110 (i.e., at an angle with respect to the first elbow portion 132). As shown, the second straight portion 134 is configured with openings 138 to connect to adjacent wall-mounted toilets that can have a similar closet carrier assembly. In another embodiment, the second straight portion 134 only includes a single opening 138 to connect to an adjacent toilet or even none at all. The second straight portion 134 also includes a vertical vent coupling 136. The frame assembly 140 includes first and second spaced apart frames 142 that are preferably identical. Referring additionally to FIGS. 9-11, a frame 142 is shown in isolation. Each frame 142 is formed by flange portions 144 interconnected by webs 146. The flange portions 144 and the webs 146 may include ribs 148 for strengthening. The ribs 148 may be on an edge as shown and/or centrally located on the flange portions 144 and webs 146. The frames 142 include a proximal leg or post 150 and a distal leg or post 152 connected by top, intermediate and bottom chords 154, 156, 158. Referring additionally to FIGS. 10-12, two top webs 147*a*, 147*b* of the webs 146 connect the flange portion 144 to the intermediate chord 156. The intermediate chord 156 is also connected to the bottom chord 158 by lower webs 149*a*, 149*b*.

The bottom chord 158 and intermediate chord 156 and the posts 150, 152 form an oval 160 that encircles the second portion 134 of the waste pipe chase conduit 130. As shown, the oval 160 also encircles a portion of the first elbow portion 132. The top and intermediate chords 154, 156 form another opening 162 that serves as a convenient lift point or handle to facilitate carrying and installation. Each proximal leg 150 is configured to couple to a distal end 128 of the respective rods 120.

As shown in FIGS. 1-4 and 9-11, each proximal post 150 includes four thread location bores 164 that structurally serve the same strengthening function as webs 146 and are thus simply another type of web. However, the thread location bores 164 also receive the distal ends 128 of the threaded rods 120, which are set in place by a nut assembly 126. There may be any number of thread location bores. By having pairs of thread location bores 164 on the proximal posts 150, the installer may select various heights for placement of the wall-mounted toilet.

Figure 3:
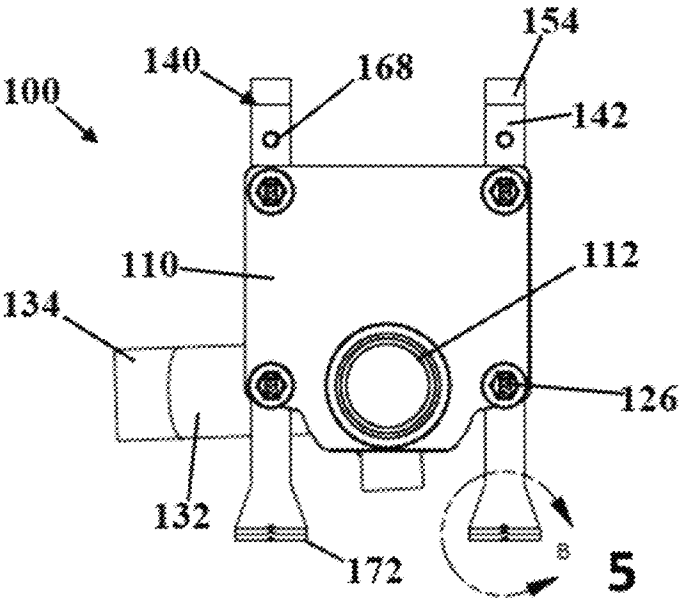
FIG. 3 is a front plan view of the closet carrier assembly of FIG. 1.
Figure 2:
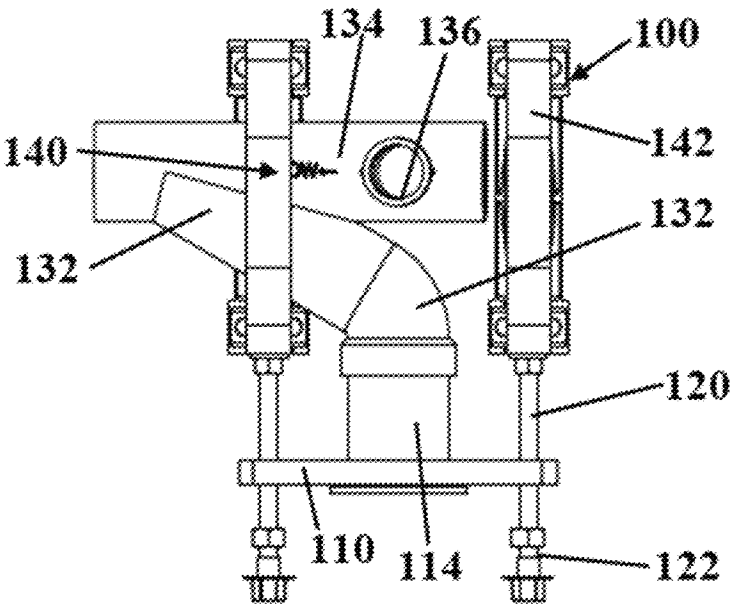
FIG. 2 is a top plan view of the closet carrier assembly of FIG. 1.
Figure 5:
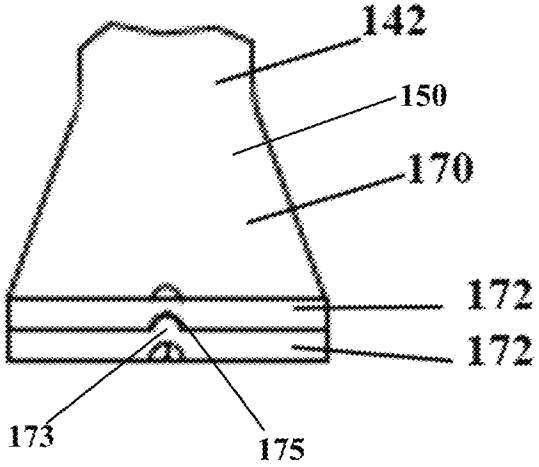
FIG. 5 is a detailed view of the area encircled in FIG. 3.
Figure 4:
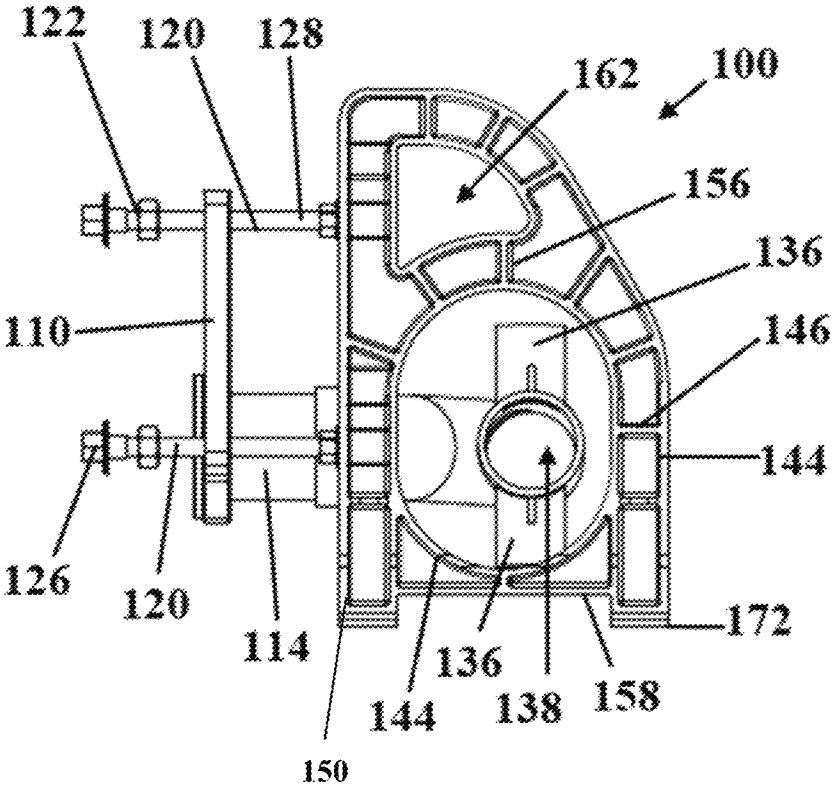
FIG. 4 is a side plan view of the closet carrier assembly of FIG. 1.
Figure 7:
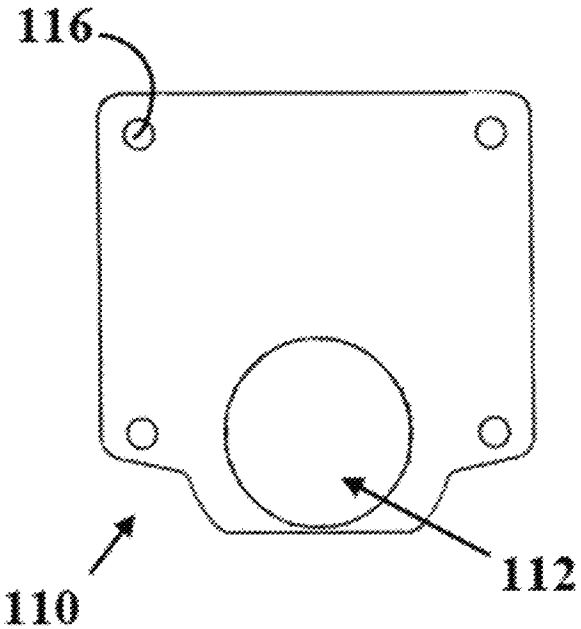
FIG. 7 is front plan view of the faceplate of FIG. 6.
Figure 6:
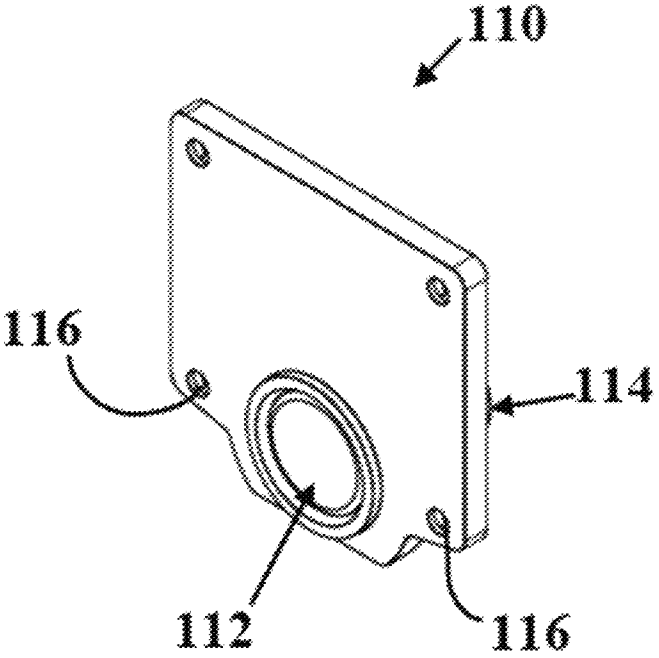
FIG. 6 is a perspective view of a faceplate for the closet carrier assembly of FIG. 1.

Referring now particularly to FIGS. 1, 3, and 5, each post 150, 152 terminates in a foot 170. As the posts 150, 152 support the toilet, it is preferable to have good contact with the floor to distribute the load. To accommodate for floor variation, one or more stackable shims 172 can be coupled under each foot 170. The feet 170, and shims 172 if desirable, form a mounting hole 174 (best seen in FIGS. 1 and 9) so that the frames 142 may be screwed down to the floor on each side of the waste pipe chase conduit 130. Preferably, the webs 146 adjacent the feet 170 form a tool clearance arc 176 (best seen in FIGS. 1 and 9) so that the installer may easily bolt down the frames 142 with a standard tool. Each stackable shim 172 also forms a protrusion 173 and a hollow 175 for coupling into the protrusion of a shim placed thereon.

Preferably, the frames are fabricated from plastic but may also be metal or other materials. Plastic fabrication allows for over-molding metal inserts 168, for example, in the threaded location bores 164. By utilizing plastic in the solid design with the flange and web construction, the frames are much lighter in weight than traditional metal legs but just as strong, durable and reliable. Each frame has two anchor points on the floor to provide stability. As a result, the closet carrier assembly is much lighter, easier to carry, as well as faster to position and install. In one embodiment, the closet carrier assembly can be carried by a single person, support 500 pounds, and be much more material and cost efficient to manufacture. It is envisioned that all or any combination of the components may be plastic and the like non-metal materials. Typically, the hardware such as rods, nuts and bolts might be metal.

Referring now to FIG. 13-16, a further embodiment of a closet carrier assembly 200 in accordance with the subject technology is shown. Some elements are similar to those of the foregoing embodiments and, thus, are not further described in great detail. The following description is directed mainly to the differences.

Some similar elements to those described in connection with above-described embodiments are indicated with the like reference numbers. For example, the closet carrier assembly 200 includes a face plate 210 coupled to a frame assembly 240. Four threaded rods 220 are supported by and extend from the frame assembly 240. The face plate 210 also couples to a waste pipe chase conduit 230 that extends through the frame assembly 240.

Figure 16:
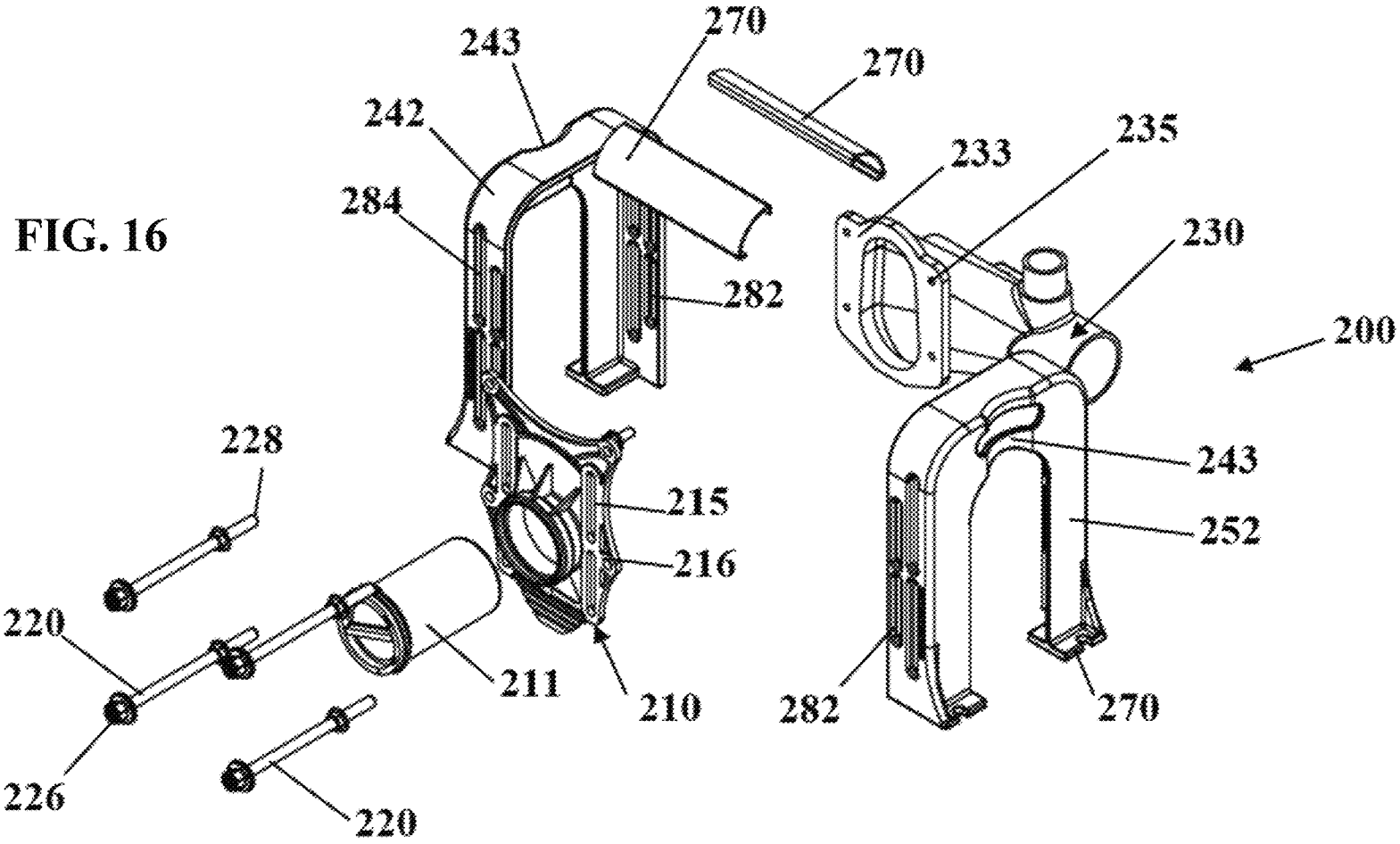
FIG. 16 is an exploded perspective view of the closet carrier assembly of FIG. 13.
Figure 17:
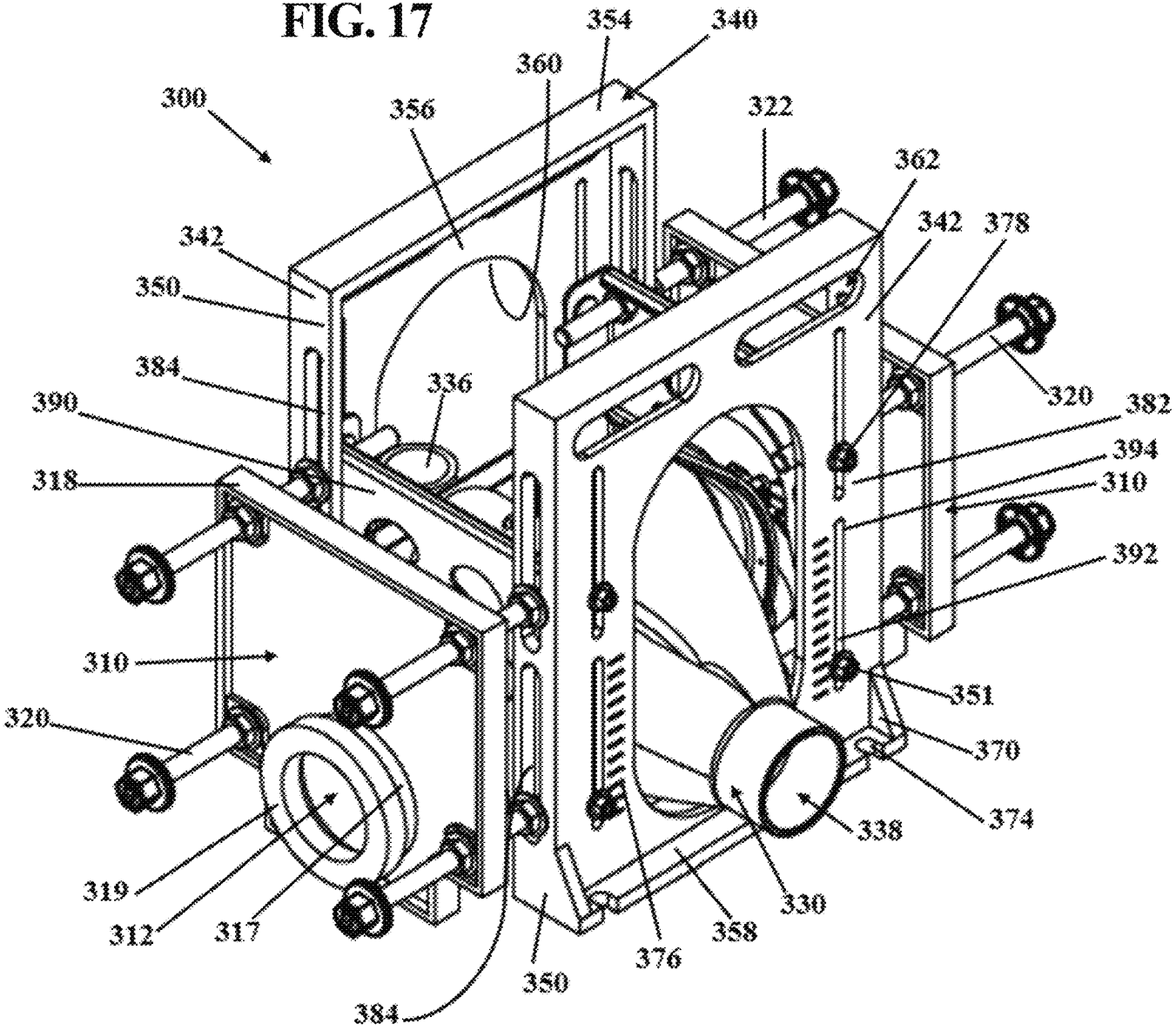
FIG. 17 is a front perspective view of another closet carrier assembly in accordance with the subject technology.
Figure 18:
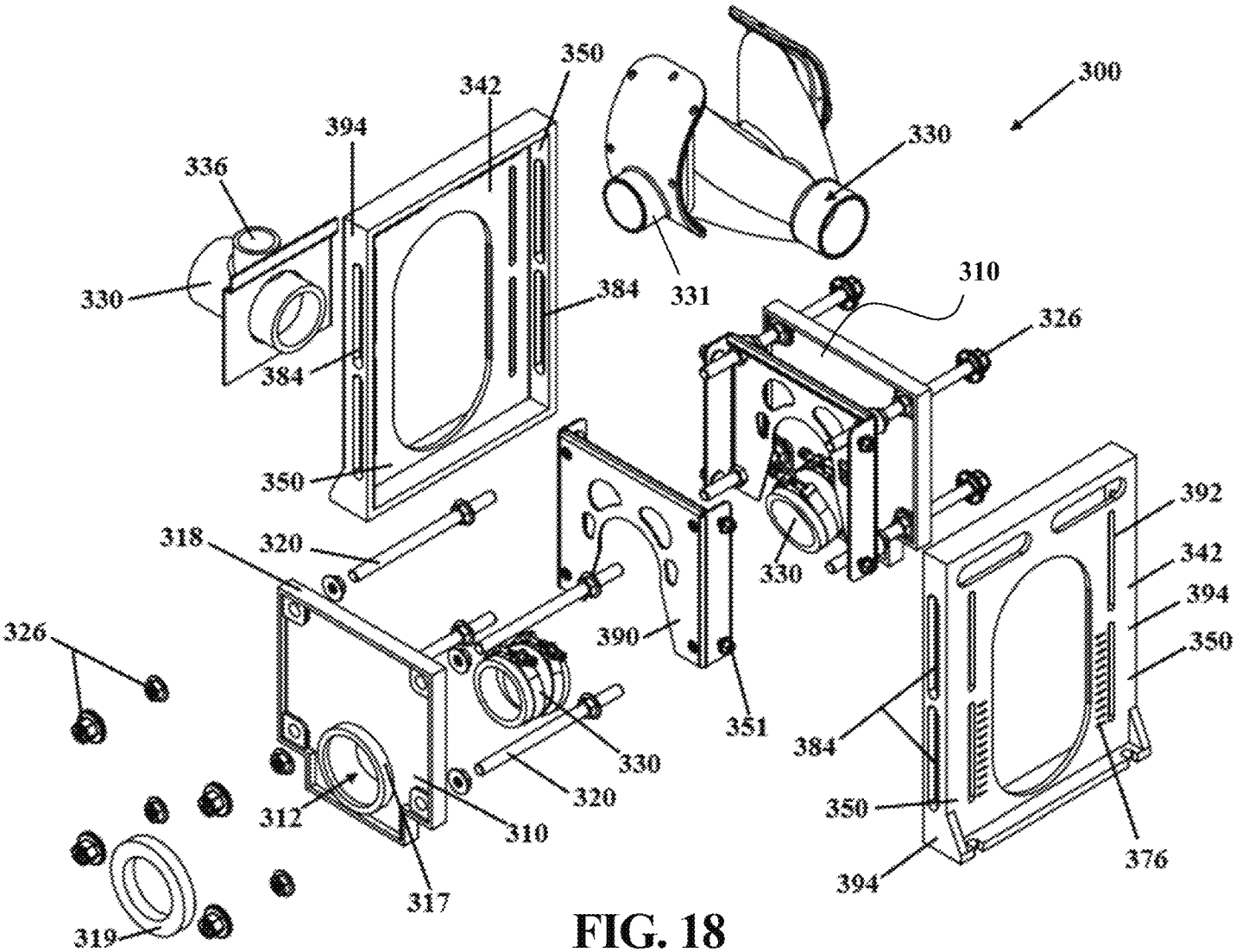
FIG. 18 is an exploded perspective view of the closet carrier assembly of FIG. 17.
Figure 20:
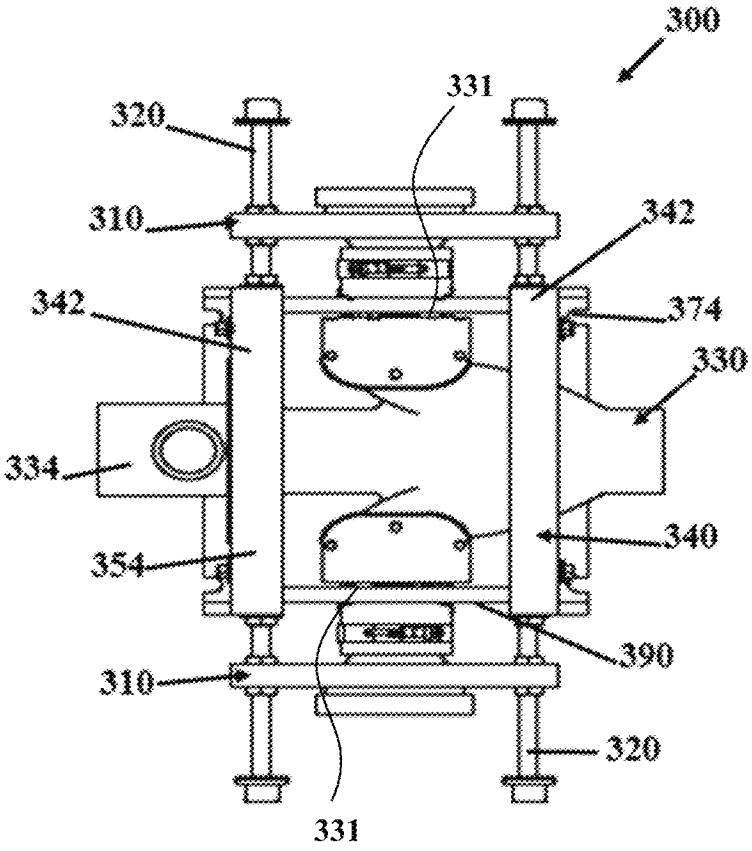
FIG. 20 is a top plan view of the closet carrier assembly of FIG. 17.
Figure 19:
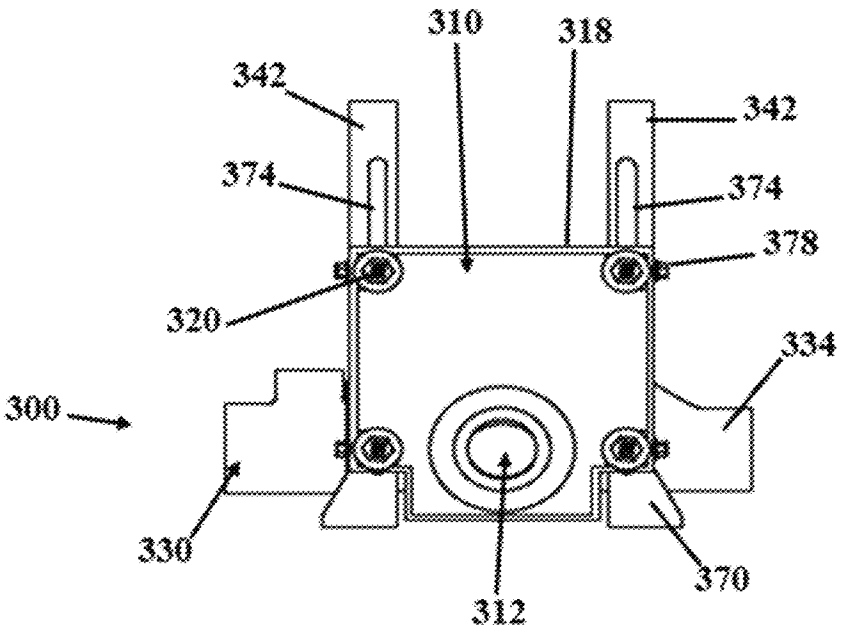
FIG. 19 is a front plan view of the closet carrier assembly of FIG. 17.
Figure 21:
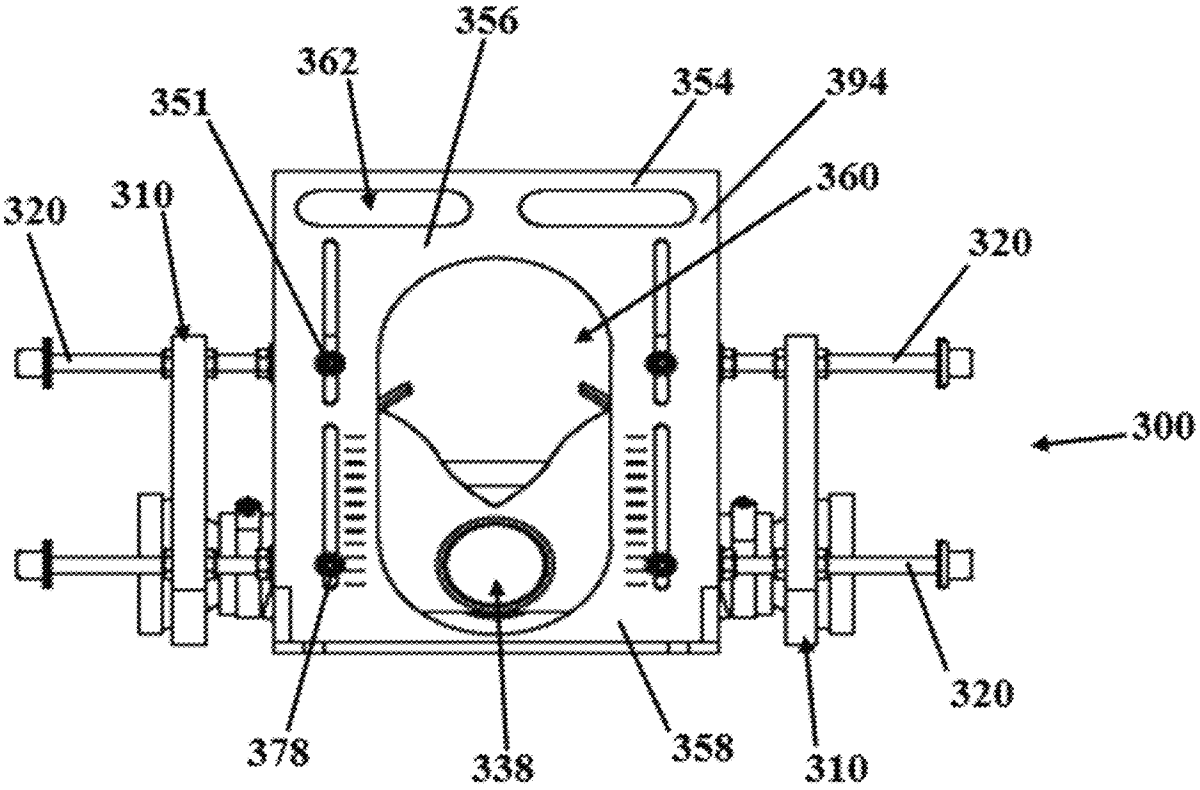
FIG. 21 is a side plan view of the closet carrier assembly of FIG. 17.

The face plate 210 includes a nipple 211 extending forward from the inlet 212. The nipple 211 is configured to couple to a waste pipe of the wall-mounted toilet. The face plate 210 couples directly to the frame assembly 240 via holes 213. The face plate 210 forms four holes 216 for receiving the rods 220 as well as four slots 215 to adjust the height of the waste pipe chase conduit 230 as best seen in FIG. 16. Fins 217 on the face plate increase the structural strength and allow making the face plate 210 from plastic.

Still referring to FIGS. 13-16, the waste pipe chase conduit 230 has a differently positioned vertical vent coupling 236. To accommodate the vent coupling 236, the respective frame 242 of the frame assembly 240 forms a vent passage 243. The opening 262 may be used to strap the vertical vent (not shown) into the vent passage 243 of the frame 242. The waste pipe chase conduit 230 also includes a flange 233 with four mounting holes 235 for coupling directly to the face plate 210.

To help stabilize the frames 242, the frame assembly 240 includes two optional braces 270 extending between the top chords 254 of the frames 242. Preferably, the braces 270 are securely attached to the frames 242 with fasteners (not shown). The braces 270 may also be plastic or steel and fix into slots formed in the frames 242.

The first and second frames 242 are again interchangeable with the proximal and distal posts 250, 252 being identically shaped. Each post 250, 252 forms two inner slots 282 for allowing adjustment to a height of the waste pipe chase conduit 230. Each post also forms two outer slots 284 for receiving the rods 220 for allowing adjustment to a height of the wall-mounted toilet. Markings 276 on the posts 250, 252 provide a visual indication of the toilet height. As can be seen by having symmetry of the frame assembly 240, a wall-mounted toilet may be hung on the front and back side of the frame assembly 240 by utilizing a second face plate and a waste pipe chase conduit so configured.

To adjust the waste line height, the closet carrier assembly 200 is largely assembled with fixing screws 278 (only one shown in FIG. 14 for simplicity) passing through the post inner slots 282 into the conduit mounting holes 235. As long as the fixing screws 278 are loose, the faceplate 210 can slide vertically to accommodate fluid connection to the waste pipe chase conduit 230. Once the face plate 210 is at the proper height, the fixing screws 278 are tightened against the frames 242 to hold the face plate 210 in place.

Similarly to adjust the toilet height, the closet carrier assembly 200 is largely assembled with the rods 220 passing through the post outer slots 284 and face plate holes 216 but without fixing the rods 220 in place until the rods 220 are at the proper height as indicated by the markings 276 or other measurement. The slots 284 allow ample vertical movement. Once the rods 220 for the toilet are at the proper height, the nuts 226 are tightened against the frames 242 to hold the rods 220 in place. The distal ends 228 may thread into the holes 216 or be secured thereto with another nut (not shown).

Referring now to FIGS. 17-21, a further embodiment of a closet carrier assembly 300 in accordance with the subject technology is shown. Some elements are similar to those of the foregoing embodiments and, thus, are not further described in great detail. The following description is directed mainly to the differences.

Some similar elements to those described in connection with above-described embodiments are indicated with the like reference numbers. For example, the closet carrier assembly 300 includes a face plate 310 coupled to a frame assembly 340. Four threaded rods 320 are supported by and extend from the frame assembly 340. The face plate 310 also couples to a waste pipe chase conduit 330 that extends through the frame assembly 340. As can be seen the closet carrier assembly 300 is configured to hold two opposing wall-mounted toilets (not shown). The at least one conduit 330 includes opposing first and second conduits 331. The following description is directed to a single side of the closet carrier assembly 300 for brevity.

The face plate 310 includes a nipple 317 forming the inlet 312. The face plate 310 and nipple 317 are plastic molded together as a single component. The nipple 317 is configured to couple to a collar 319 that connects to a waste pipe of the wall-mounted toilet. The face plate 310 includes an outer frame 318 to increase the structural strength.

To help stabilize the frames 342, the frame assembly 340 includes two optional plates 390 extending parallel to and behind the face plate 310. Each plate 390 mounts between the posts 350 of the frames 342. Preferably, the plates 390 are securely attached to the frames 342 with fasteners 351 and made of plastic or steel. One or no plates 290 may be used.

The two frames 342 are again interchangeable with all four posts 350 being identically shaped. Each post 350 also forms rod slots 384 for receiving the rods 320 for allowing adjustment to a height of the wall-mounted toilet. Each post 350 also forms slots 392 for allowing adjustment to a height of the waste pipe chase conduit 330 by variably mounting the plates 390. The slots 392 are not adjacent the face plate 310 but rather on a side 394. The markings 376 are also on the side 394 to provide a visual indication of the position. As illustrated by the second faceplate 310 and additional rods 320, a second wall-mounted toilet may be hung on the back side of the frame assembly 340. To adjust the waste line height and the toilet height, the slots 384, 392 of the closet carrier assembly 300 are similarly utilized as noted above.

As would be appreciated by those of ordinary skill in the art based upon review of the subject disclosure, the waste pipe chase conduit may vary to allow connecting a very long line of wall-mounted toilets. Thus, it may be necessary to adjust various heights to create proper flow as well as toilet heights for not just typical users but the very young and very old. Further, by creating structurally strong features, the components can be manufactured from plastic as opposed to metal to beneficially reduce the weight for easier carrying and installation by a single person. Additionally, the various slots and passages can be utilized to provide ample easy adjustments.

It will be appreciated by those of ordinary skill in the pertinent art that the functions of several elements may, in alternative embodiments, be carried out by fewer elements, or a single element. Similarly, in some embodiments, any functional element may perform fewer, or different, operations than those described with respect to the illustrated embodiment. Also, functional elements (e.g., connections, plates, conduits, flanges, ribs, webs, bolts, threads, rods and the like) shown as distinct for purposes of illustration may be incorporated within other functional elements in a particular implementation. Still further, various aspects of the different embodiments may be mixed and matched to other embodiments. Further, although the subject technology has been described with respect to the field of closet carriers for toilets, it is envisioned that the subject technology would be equally applicable to other fields and applications such as on urinals and other plumbing applications.

All patents, patent applications and other references disclosed herein are hereby expressly incorporated in their entireties by reference. While the subject technology has been described with respect to preferred embodiments, those skilled in the art will readily appreciate that various changes and/or modifications can be made to the subject technology without departing from the spirit or scope of the invention as defined by the appended claims. For example, each claim may depend from any or all claims in a multiple dependent manner even though such has not been originally claimed.

What is claimed is:

1. A closet carrier assembly for fixing a wall-mounted toilet above a floor, the closet carrier comprising:

at least first and second spaced apart frames, each frame comprising, a front leg, a rear leg, at least one arm connecting the front and rear legs, the at least one arm comprising a top chord portion connecting the front and rear legs, and an intermediate chord portion coupled to the top chord portion by webs and positioned relative to the top chord portion to form a recess configured for manually carrying the respective frame and to structurally strengthen the respective frame;

a face plate having a passageway extending between: an inlet for coupling to a wall mounted toilet; and an outlet, the face plate secured to the front legs of the frames so that the face plate is suspended above and not touching the floor; and a waste pipe chase coupled to the outlet of the passageway of the face plate so that a distance between the front legs and the face plate is determined by a length of the passageway, wherein the at least first and second spaced apart frames anchor and carry the wall-mounted toilet, the waste pipe chase including at least one conduit extending between the legs of one of the first and the second frames.

2. The closet carrier assembly as recited in claim 1, wherein the face plate is supported by the front legs of the frames with spacing rods extending from front sides of the front legs of the frames and through openings in the face plate, wherein distal ends of the spacing rods are adapted to receive the wall-mounted toilet so that the front legs of the frames fully support the wall-mounted toilet.

3. The closet carrier assembly as recited in claim 2, wherein the webs and the intermediate chord portion structurally strengthen the respective frame, wherein: each front leg forms an upper and lower pair of vertically spaced threaded anchor bores to form a lower set of four bores and an upper set of four bores, wherein the upper pairs of vertically spaced threaded anchor bores extend between the top chord portion and the intermediate cord portion for structurally strengthening the respective frame; and the openings in the face plate are four holes; and each spacing rod is configured to extend through one of the four holes with a distal end configured to secure in the respective vertically spaced threaded anchor bores and a proximal end configured to couple to the wall-mounted toilet, and wherein a vertical position of the spacing rods on the frames is configured to be adjusted by selectively inserting the spacing rods into one of the lower and upper set of threaded anchor bores.

4. The closet carrier assembly as recited in claim 3, wherein the front and rear legs of the at least first and second spaced apart frames: include opposing chords interconnected by leg webs; and extend upwardly from a respective foot, and wherein each foot forms a mounting hole for receiving a floor fastener and at least one of the leg webs adjacent the respective mounting hole forms a tool clearance arc to operatively access the floor fastener, wherein two leg webs on each of the front and rear legs form the lower set of four bores, and further comprising a plurality of stackable shims for placement under the feet, each stackable shim forming a mounting hole for receiving the floor fastener, a protrusion, and a hollow for coupling with one of the protrusions so that a subset of the plurality of stackable shims are configured to be deployed to selectively adjust a height of the at least one faceplate.

5. The closet carrier assembly as recited in claim 1, wherein the at least one conduit of the waste pipe chase comprises opposing first and second conduits, wherein the first conduit extends between the legs of the first frame and the second conduit extends between the legs of the second frame.

6. The closet carrier assembly as recited in claim 1, wherein the at least one arm of the frames comprises an upper arm and a lower arm and wherein the at least one conduit of the waste pipe chase extends between the legs and the arms of one of the first and the second frames.

7. The closet carrier assembly as recited in claim 1, wherein the face plate is secured to the front legs of the frames and a second face plate is secured to the rear legs of the frames, and the waste pipe chase is coupled to each of the outlets of the passageways of the first and second face plates.

8. The closet carrier assembly as recited in claim 1, wherein the chords of the frames are fabricated from plastic and wherein the threaded anchor bores are formed by overmolding plastic about a metal threaded insert.

9. A closet carrier assembly for a toilet assembly suspended above a floor on a wall, the closet carrier assembly comprising:

a face plate defining: an inlet configured to couple to the toilet assembly; an outlet in fluid communication with the inlet; and at least two spaced apart faceplate throughholes;

a waste pipe chase conduit having: a first portion configured to couple to the outlet of the face plate; and a second portion in fluid with the first portion and extending at an angle from the first portion;

first and second frames configured to be spaced apart, each frame including:

a distal leg;

a proximal leg having: a flange portion; and a plurality of webs extending from the flange portion for strengthening the flange portion, wherein: at least one of the plurality of webs on each proximal leg defines a first upper threaded bore; and the second portion is configured to pass between the distal and proximal legs of the first frame; and a top arm connecting the proximal and distal legs; and at least two rods that slideably extend through the faceplate throughholes, each rod having a distal threaded end coupled in one of the threaded bores and a proximal threaded end for coupling to the toilet assembly so that the proximal and distal legs of the frames stand on the floor with the at least two rods extending from the threaded bores of the frames configured to support the toilet assembly.

10. The closet carrier assembly as recited in claim 9, wherein at least one of the distal and proximal legs defines a leg mounting hole for securing the respective leg to the floor with a fastener and further comprising stackable shims for placement under the legs, each stackable shim forming a shim mounting hole for receiving the fastener, a protrusion, and a hollow for coupling with the protrusion of another shim.

11. The closet carrier assembly as recited in claim 9, wherein each proximal leg further comprises:

a first top inner chord portion: forming a hand recess for manually carrying the closet carrier assembly; and coupled to the top chord portion of the respective frame by two top webs, wherein the two top webs and the first top inner chord portion structurally strengthen the respective frame, and wherein one of the two top webs forms a second upper threaded bore; and a first lower inner chord portion: forming a conduit recess encircling the second portion; coupled to the first top inner chord portion of the respective frame by a middle web that structurally strengthens the respective frame; and coupled to the flange portion of the respective frame by two lower webs that are vertically spaced, structurally strengthen the respective frame, and form respective bottom threaded bores, wherein: the at least two rods is four rods so that the first and second upper threaded bores as well as the two bottom threaded bores are configured to selectively positioning the four rods therein for mounting the toilet assembly at two different heights above the floor.

12. A closet carrier assembly for fixing a toilet above a floor, the closet carrier comprising:

a first frame including a front leg, a rear leg, and an arm connecting the front and rear legs;

a second frame spaced apart from the first frame, the second frame being the same as the first frame, wherein the legs of the frames have feet defining frame mounting holes for securing the respective leg to the floor with fasteners;

a face plate having a passageway extending between an inlet and an outlet, wherein the inlet is configured to couple to the toilet and the face plate is secured to the front legs of the first and second frames by rods so that the face plate is suspended above the floor;

a waste pipe chase coupled to the outlet of the passageway of the face plate so that a distance between the front legs and the face plate is determined by a length of the passageway, wherein the first and second spaced apart frames carry the weight of the toilet, the waste pipe chase including at least one conduit extending between the legs of one of the first and the second frames; and stackable shims for placement under the legs, each stackable shim forming: a shim mounting hole for receiving the fasteners; a protrusion; and a hollow for coupling with the protrusion of another shim.

* * * * *